US008857814B2

(12) United States Patent
Sugitani

(10) Patent No.: US 8,857,814 B2
(45) Date of Patent: Oct. 14, 2014

(54) SHEET EJECTION DEVICE

(71) Applicant: Riso Kagaku Corporation, Tokyo (JP)

(72) Inventor: Hiroshi Sugitani, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 13/865,510

(22) Filed: Apr. 18, 2013

(65) Prior Publication Data

US 2013/0285311 A1 Oct. 31, 2013

(30) Foreign Application Priority Data

Apr. 25, 2012 (JP) ..... 2012-099579

(51) Int. Cl.

| | |
|---|---|
| ***B65H 31/00*** | (2006.01) |
| ***G03G 15/00*** | (2006.01) |
| ***B65H 31/10*** | (2006.01) |
| ***B65H 29/70*** | (2006.01) |
| ***B65H 31/20*** | (2006.01) |

(52) U.S. Cl.

CPC ..... *B65H 31/00* (2013.01); *B65H 2405/11151* (2013.01); *B65H 2405/1115* (2013.01); *B65H 2405/15* (2013.01); *B65H 2405/1122* (2013.01); *B65H 2401/13* (2013.01); *G03G 15/6552* (2013.01); *G03G 15/6538* (2013.01); *B65H 2801/27* (2013.01); *G03G 2215/00911* (2013.01); *B65H 2301/5133* (2013.01); *B65H 31/10* (2013.01); *B65H 2401/115* (2013.01); *B65H 2405/1132* (2013.01); *B65H 2405/11152* (2013.01); *B65H 2401/15* (2013.01); *B65H 29/70* (2013.01); *B65H 31/20* (2013.01); *B65H 2301/51214* (2013.01)

USPC ..... 271/208

(58) Field of Classification Search

CPC ..... B65H 2301/533
USPC ..... 271/208
See application file for complete search history.

(56) References Cited

U.S. PATENT DOCUMENTS

| | | | | |
|---|---|---|---|---|
| 3,826,379 | A * | 7/1974 | Wright | 271/208 |
| 4,501,418 | A * | 2/1985 | Ariga et al. | 271/187 |
| 4,660,824 | A * | 4/1987 | Hermkens et al. | 271/208 |
| 6,102,651 | A * | 8/2000 | Hahne et al. | 414/788.9 |
| 6,505,829 | B2 * | 1/2003 | Kawata | 271/208 |
| 7,080,835 | B2 * | 7/2006 | Oikawa et al. | 271/208 |
| 7,708,271 | B2 * | 5/2010 | Major, Jr. | 271/208 |
| 2008/0029952 | A1 * | 2/2008 | Major | 271/207 |

FOREIGN PATENT DOCUMENTS

JP 2002-274741 A 9/2002

* cited by examiner

*Primary Examiner* — Jeremy R Severson
(74) *Attorney, Agent, or Firm* — Nath, Goldberg & Meyer; Jerald L. Meyer

(57) ABSTRACT

A sheet ejection device includes a plurality of second sheet abutting members and a plurality of conductive members. Each second sheet abutting member has a non-conductive sheet regulating surface that abuts on a rear end portion in an ejecting direction of each sheet on a sheet output tray to regulate movement thereof. Each conductive member is attached at a position lower than a sheet drop height position and in the vicinity of each second sheet abutting member in a grounded state in the sheet width direction. Each conductive member attracts a rear end portion in the ejecting direction of a sheet on the uppermost layer of a plurality of sheets stacked on the sheet output tray, up to the sheet drop height position on the sheet regulating surface of the second sheet abutting member.

3 Claims, 3 Drawing Sheets

SHEET EJECTION DEVICE

CROSS REFERENCE TO RELATED APPLICATION

This application claims benefit of priority under 35 U.S.C. §119 to Japanese Patent Application No. 2012-099579 filed on Apr. 25, 2012, the entire contents of which are incorporated by reference herein.

BACKGROUND OF THE INVENTION

1. Field of the Invention

The present invention relates to a sheet ejection device which can align, in an orderly manner, sheets on a sheet output tray for all the types of sheets such as a thin sheet, a plain sheet, a thick sheet and the like, when these sheets are stacked on the sheet output tray by sequentially dropping, from a sheet ejection position, a plurality of sheets ejected from an image forming apparatus in a sheet ejecting direction.

2. Description of the Related Art

Recently, printers such as an inkjet printer, a stencil printer, a laser printer and the like and an image forming apparatus capable of forming images on a sheet by using a copier or the like perform printing and copying on a large amount of sheets.

When sheets are to be fed in this type of image forming apparatus, if, for example, friction occurs between the sheet and a feeding roller, static electricity collects on a sheet feeding path and the sheets.

As a result, when the plurality of sheets charged in the image forming apparatus is sequentially ejected toward the sheet output tray in the sheet ejecting apparatus installed on the sheet ejection side of the image forming apparatus, each of the ejected sheets leans on an end fence, a pair of side fences or the like provided around the sheet output tray due to the static electricity and remarkably deteriorates orderliness of the ejected sheets on the sheet output tray. In some cases, sheet jam is likely to occur.

Regarding the above-described problem, the applicant has already proposed a sheet ejection device which can favorably align sheets on the sheet output tray while removing electricity from each of the ejected sheets when sequentially ejecting the plurality of sheets charged in the image forming apparatus (For example, see Patent Literature 1: Japanese Patent Application Laid-Open Publication No. 2002-274741).

The sheet ejection device disclosed in Patent Literature 1 is provided with a sheet output tray, an end face, and a pair of side fences (not shown). On the sheet output tray, the plurality of sheets ejected from the image forming apparatus is stacked. The end fence abuts on a front end portion in the ejecting direction of each sheet stacked on the sheet output tray and regulates movement of the front end portion. The side fences regulate movement of end portions in the right-and-left direction while guiding, along the ejecting direction, the right and left end portions in the width direction crossing the ejecting direction of each sheet stacked on the sheet output tray. A conductive member using a metal material or the like is attached in an elongated manner on each of the inner surfaces of the end fence and the side fences, from an upper portion of the end fence and the side fences toward the sheet output tray, respectively. Each of the conductive members is earthed from the sheet output tray to the image forming apparatus side.

With the above-described configuration, when the plurality of sheets charged in the image forming apparatus is sequentially ejected toward the sheet output tray, the front end portion in the ejecting direction and the right and left end portions in the width direction of each ejected sheet are brought into contact with the conductive members attached to the inner surfaces of the end fence and the side fences, respectively, and electricity is removed from the ejected sheets. As a result, the sheets can be favorably aligned on the sheet output tray.

Generally, in an image forming apparatus and a sheet ejection device applied to the image forming apparatus, all the types of sheets such as a thin sheet having a basis weight of 60 $g/m^2$ or less, a plain sheet having a basis weight of 60 $g/m^2$ to 120 $g/m^2$, a thick sheet having a basis weight of 120 $g/m^2$ or more and the like can be applied. The weight of sheets increases in order of a thin sheet, a plain sheet, and a thick sheet, and rigidity of the sheets also increases in order of a thin sheet, a plain sheet, and a thick sheet.

In the sheet ejection device disclosed in Patent Literature 1, when the plurality of sheets charged in the image forming apparatus is sequentially ejected, the front end portion in the ejecting direction and the right and left end portions in the width direction of each ejected sheet get close to the conductive members attached to each of the inner surfaces of the end fence and the side fences, whereby the front end portion in the ejecting direction and the right and left end portions in the width direction of each ejected sheet are attracted to the conductive members, respectively, by Coulomb force at the time of electrostatic induction.

At this time, when a plain sheet or a thick sheet is used, even if the front end portion in the ejecting direction and the right and left end portions in the width direction of each of the charged plain sheets or thick sheets are attracted to the conductive members attached to the inner surfaces of each of the end fence and the side fences, respectively, the weight and rigidity of the plain sheet or thick sheet are large, and thus the charged plain sheet or thick sheet is brought into contact with the conductive members without being scarcely affected by the attracting force from these conductive members, and falls down while the electricity is removed therefrom. Therefore, since the plain sheet or thick sheet is stacked on the sheet output tray while its flat posture is maintained, the sheet ejection device disclosed in Patent Literature 1 can favorably align the plain sheet or thick sheet on the sheet output tray.

In contrast, in the case of using the thin sheet, the weight and rigidity of the thin sheet are small, and thus the front end portion in the ejecting direction and the right and left end portions in the width direction of the thin sheet are attracted to the conductive members to be inclined. Accordingly, since the thin sheet leans on the inner surfaces of the end face and the side fences and is stacked on the sheet output tray, the sheet ejection device disclosed in Patent Literature 1 cannot align the thin sheet on the sheet output tray favorably.

Moreover, when a thin sheet is used, the thin sheet to be subsequently ejected collides against or overlaps with the thin sheet leaning on the inner surfaces of the end fence and the side fences, which might cause an ejected sheet jam in some cases.

SUMMARY OF THE INVENTION

The present invention has an object to provide a sheet ejection device (1) which can align, in an orderly manner on a sheet output tray, particularly a thin sheet having light weight and low rigidity among all the types of sheet such as a thin sheet, a plain sheet, a thick sheet and the like, when a plurality of sheets ejected in a sheet ejecting direction from an image forming apparatus is sequentially dropped from an ejection position and these sheets are stacked on the sheet output tray and (2) which can prevent an ejected sheet jam which might occur when the thin sheet is used.

According to one aspect of the present invention, there is provided a sheet ejection device in which a plurality of sheets ejected in a sheet ejecting direction is sequentially dropped from an ejection position and the plurality of sheets are stacked on a sheet output tray, the device including a detector that detects a sheet drop height position set between the ejection position and a sheet on an uppermost layer of the plurality of sheets stacked on the sheet output tray, a sheet output tray elevation portion that elevates up/down the sheet output tray in accordance with a stacked amount of the plurality of sheets so that the sheet drop height position becomes substantially constant on the basis of a detection result from the detector, a sheet abutting member that has a non-conductive sheet regulating surface that abuts on at least one of a front end portion and a rear end portion of each sheet on the sheet output tray to regulate movement of the one end portion, and a conductive member that is attached at a position lower than the sheet drop height position and in the vicinity of the sheet abutting member in a grounded state in the sheet width direction, and attracts at least one of a front end portion and a rear end portion of the sheet on the uppermost layer of the plurality of sheets stacked on the sheet output tray, up to the sheet drop height position on the sheet regulating surface of the sheet abutting member.

According to one aspect of the present invention, the conductive member is located behind the sheet regulating surface of the sheet abutting member.

According to one aspect of the present invention, the sheet ejection device is provided with the detector, the sheet output tray elevation portion, the sheet abutting member, and the conductive member. The detector detects the drop height position of each ejected sheet when the plurality of sheets ejected in the sheet ejecting direction is sequentially dropped from the ejection position and the plurality of sheets is stacked on the sheet output tray. The sheet output tray elevation portion elevates up/down the sheet output tray in accordance with the stacked amount of the plurality of sheets so that the sheet drop height position becomes substantially constant. The sheet abutting member abuts on at least one of the front end portion and the rear end portion of each sheet on the sheet output tray and regulates movement of the one end portion. The conductive member attracts at least one of the front end portion and the rear end portion of the sheet on the uppermost layer of the plurality of sheets stacked on the sheet output tray, up to the sheet drop height position on the sheet regulating surface of the sheet abutting member.

Therefore, for all the types of sheets such as a thin sheet, a plain sheet, a thick sheet and the like, at least one of the front end portion and the rear end portion of the sheet on the uppermost layer of the plurality of sheets stacked on the sheet output tray is attracted up to the sheet drop height position on the sheet regulating surface of the sheet abutting member by Coulomb force at the time of electrostatic induction from the conductive member attached in the vicinity of the sheet abutting member. Accordingly, since at least one of the front end portion and the rear end portion of the sheet on the uppermost layer is brought into contact, without inclination, with the sheet regulating surface of the sheet abutting member, at least one side of the front end portion and the rear end portion can be stacked, in an orderly manner, on the sheet output tray. Particularly, if a thin sheet which is light-weighted and which has small rigidity is used for the sheet, the effect of orderly arrangement of the thin sheet on the sheet output tray becomes further remarkable. Furthermore, since the thin sheet can be stacked, in an orderly manner, on the sheet output tray, an ejected sheet jam which might occur when thin sheet is used can be prevented.

Moreover, static electricity still remaining on the sheet can be removed by the conductive member.

According to one aspect of the present invention, the conductive member is located behind the sheet regulating surface of the sheet abutting member. Thus, at least one of the front end portion and the rear end portion of the sheet can be reliably, without inclination, brought into contact with the sheet regulating surface of the sheet abutting member.

DESCRIPTION OF THE EMBODIMENTS

Hereinafter, a sheet ejection device according to an embodiment of the present invention will be described in detail by referring to FIGS. 1 to 5.

Figure 1:
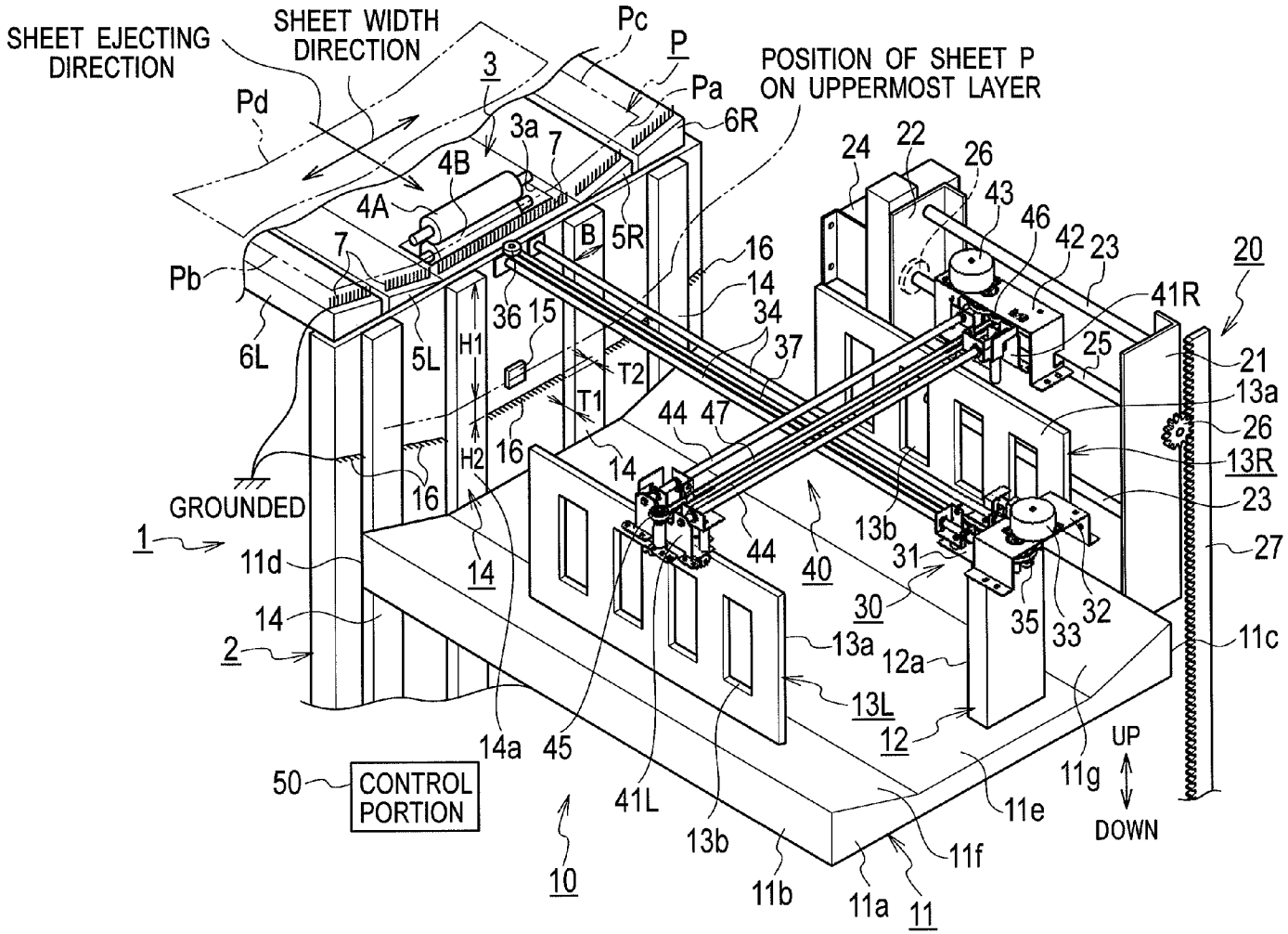
FIG. 1 is a perspective view illustrating a sheet ejection device according to an embodiment of the present invention and an image forming apparatus to which this sheet ejection device is applied.

FIG. 1 illustrates, in a perspective manner, a sheet ejection device 10 according to the embodiment of the present invention and an image forming apparatus 1 to which this sheet ejection device 10 is applied.

As illustrated in FIG. 1, the sheet ejection device 10 is applied to the image forming apparatus 1 which can form images on a sheet P through the use of a printer such as an inkjet printer, a stencil printer, a laser printer and the like, or a copier. The sheet ejection device 10 is installed on the downstream side in a sheet ejecting direction of the image forming apparatus 1.

First, the image forming apparatus 1 to which the sheet ejection device 10 is applied will be described.

In the image forming apparatus 1, all the types of sheets such as a thin sheet having a basis weight of 60 g/m$^2$ or less, a plain sheet having a basis weight of about 60 g/m$^2$ to 120 g/m$^2$, a thick sheet having a basis weight of 120 g/m$^2$ or more and the like can be applied. The image forming apparatus 1 is configured to be able to form images on the thin sheet, the plain sheet, and the thick sheet.

In the image forming apparatus 1, a rear-side plate 2 constituting a part of a box-shaped housing (not shown) is provided substantially perpendicularly.

At a substantially center portion on an upper part of the rear-side plate 2, a planar sheet guide plate 3 using a metal material is horizontally provided, in the ejecting direction of the sheet P, orthogonally to the rear-side plate 2. On the planar sheet guide plate 3, a pair of an upper sheet feeding roller 4A and a lower sheet feeding roller 4B is rotatably installed.

At this time, the upper sheet feeding roller 4A is a driven roller, and the lower sheet feeding roller 4B is a driving roller.

A part of the lower sheet feeding roller 4B protrudes upward from the inside of a square hole 3*a* formed in the planar sheet guide plate 3 from the back surface of the planar sheet guide plate 3. The upper sheet feeding roller 4A is supported by an arm (not shown) swingably and is in contact with the lower sheet feeding roller 4B at the square hole 3*a*.

As a result, the sheet P on which an image is formed in the image forming apparatus 1 is ejected by the upper sheet feeding roller 4A and the lower sheet feeding roller 4B in the sheet ejecting direction, with a front end portion Pa in the ejecting direction of the sheet P as the head.

A pair of first sheet stiffness-imparting wing members 5L and 5R is arranged symmetrically with respect to the planar sheet guide plate 3 along the sheet width direction orthogonal to the sheet ejecting direction. The first sheet stiffness-imparting wing members 5L and 5R are constituted by using a metal material and each is formed having a triangular side face when seen from the sheet ejecting direction. A pair of second sheet stiffness-imparting wing members 6L and 6R is installed symmetrically, in the sheet width direction, with respect to the planar sheet guide plate 3 and the first sheet stiffness-imparting wing members 5L and 5R. The second sheet stiffness-imparting wing members 6L and 6R are constituted by using a metal material and each is formed having a trapezoidal side face when seen from the sheet ejecting direction.

Inclined surfaces of the first sheet stiffness-imparting wing members 5L and 5R are connected to inclined surfaces of the second sheet stiffness-imparting wing members 6L and 6R, respectively. The first sheet stiffness-imparting wing members 5L and 5R and the second sheet stiffness-imparting wing members 6L and 6R are capable of vertical movement independently from each other by a driving mechanism (not shown). By symmetrically changing the height in the vertical direction of the inclined surface of each sheet stiffness-imparting wing member in accordance with rigidity of the sheet P, a stiffness-imparting amount to the sheet P can be variably set.

At the most downstream portion in the sheet ejecting direction of each of the planar sheet guide plate 3, the first sheet stiffness-imparting wing members 5L and 5R, and the second sheet stiffness-imparting wing members 6L and 6R, static elimination brushes 7 having conductivity are attached in the sheet width direction, respectively. Each of the static elimination brushes 7 has flexibility and is grounded in the image forming apparatus 1.

The static elimination brushes 7 are linearly attached in the sheet width direction by using an ultra-thin stainless wire having conductivity or a conductive carbon wire, and face the sheet P with a distance of approximately 0 to 1 mm from the lower surface of the sheet P.

With this configuration, when the sheet P on which an image is formed in the image forming apparatus 1 is ejected, even if friction occurs between the sheet P and the feeding roller (not shown) and static electricity collects on a sheet feeding path (not shown) or the sheet P, for example, when the charged sheet P is ejected to the sheet ejection device 10 side by the upper sheet feeding roller 4A and the lower sheet feeding roller 4B, the electricity of the charged sheet P is removed by the static elimination brushes 7 attached to the planar sheet guide plate 3, the first sheet stiffness-imparting members 5L and 5R, and the second sheet stiffness-imparting members 6L and 6R in the sheet width direction, respectively.

At this time, the static-eliminated sheet P is not necessarily fully static-eliminated by each of the static elimination brushes 7 and a part of the sheet P might be ejected to the sheet ejection device 10 side with static electricity remaining thereon.

Therefore, in the sheet ejection device 10, the plurality of sheets P charged in the image forming apparatus 1 is sequentially ejected in the sheet ejecting direction while being static-eliminated by the static elimination brushes 7 provided at the sheet ejecting portion and the plurality of sheets P sequentially dropped from the ejection position is stacked on a sheet output tray 11. Furthermore, in the sheet ejection device 10, a plurality of regulating plates is provided around the sheet output tray 11 in order to regulate each end portion on the periphery of the sheet P. A sheet regulating surface of each regulating plate is formed on a flat surface having non-conductivity. A conductive member for attracting the sheet up to a sheet drop height position is attached in the vicinity of the regulating plate (sheet abutting plate) for regulating an end portion in the ejecting direction of the sheet P in the plurality of regulating plates. The conductive member is grounded. With this configuration, the sheets P can be aligned, in an orderly manner, on the sheet output tray 11.

The plurality of sheet regulating surfaces of the regulating plates is formed of a material having non-conductivity or a material subjected to non-conductive treatment through the use of a resin film.

As illustrated in FIG. 1, the sheet ejection device 10 is provided with the sheet output tray 11 and a sheet output tray elevation mechanism portion 20. The sheet output tray 11 is formed into a rectangular shape by using a resin material or the like having rigidity and non-conductivity. The plurality of sheets ejected in the sheet ejecting direction from the image forming apparatus 1 is sequentially dropped from the ejection position and stacked on the sheet output tray 11. The sheet output tray elevation mechanism portion 20 elevates the sheet output tray 11, in the vertical direction, in accordance with the stacked amount of the sheets P so that a sheet drop height H1 between the ejection position of the sheet P and the sheet P on the uppermost layer stacked on the sheet output tray 11 becomes substantially constant.

The sheet drop height H1 is set to, for example, approximately 100 mm.

The sheet ejection device 10 is provided with a first sheet abutting member (end fence) 12 and a first sheet abutting member moving mechanism portion 30. The first sheet abutting member 12 is formed into a rectangular plate shape by using a resin material or the like having rigidity and non-conductivity. The first sheet abutting member 12 is provided orthogonally to the ejecting direction of the sheet P in a state of being movably suspended in the sheet ejecting direction on a top plate (not shown) provided above the sheet output tray 11. The first sheet abutting member 12 abuts on the front end portion Pa in the ejecting direction of the sheet P that is ejected from the image forming apparatus 1 and that is dropped onto the sheet output tray 11, and regulates movement of the front end portion Pa of the sheet P. The first sheet abutting member moving mechanism portion 30 moves the first sheet abutting member 12 in the sheet ejecting direction, in accordance with a length dimension of the sheet P.

The sheet ejection device 10 is provided with a pair of sheet width-direction regulating plates (side fences) 13L and 13R and a sheet width-direction regulating plate moving mechanism portion 40. Each of the sheet width-direction regulating plates 13L and 13R is formed into a rectangular plate shape by using a resin material or the like having rigidity and non-conductivity. The sheet width-direction regulating plates 13L and 13R are provided facing each other with intervals between them parallel to the ejecting direction of the sheet P in a state of being movably suspended in the sheet width direction on the top plate (not shown) provided above the sheet output tray 11. The sheet width-direction regulating plates 13L and 13R guide the left and right end portions Pb and Pc in the width direction of the sheet P that is ejected from the image forming apparatus 1 and that is dropped onto the sheet output tray 11 on the ejecting direction, and regulate movement of the left and right end portions Pb and Pc of the sheet P. The sheet width-direction regulating plate moving mechanism portion 40 moves the sheet width-direction regulating plates 13L and 13R in the sheet width direction, in accordance with a width dimension of the sheet P.

The sheet ejection device 10 is provided with a plurality of second sheet abutting members 14. Each of the second sheet abutting members 14 is formed into a rectangular plate shape in the vertical direction by using a resin material or the like having rigidity and non-conductivity. The plurality of second sheet abutting members 14 is attached at predetermined intervals in the sheet width direction on the rear-side plate 2 of the image forming apparatus 1. The plurality of second sheet abutting members 14 abut on a rear end portion Pd in the ejecting direction of the sheet P that is ejected from the image forming apparatus 1 and that is dropped onto the sheet output tray 11, and regulate movement of the rear end portion Pd of the sheet P.

The sheet ejection device 10 is provided with a light-reflective type sensor 15 for detecting a sheet drop height position, and a plurality of conductive members 16. The sensor 15 is mounted at the substantially central part in the width direction of the sheet on the rear-side plate 2 of the image forming apparatus 1. The sensor 15 detects a position of the sheet drop height H1 (sheet drop height position) between the ejection position of the sheet P and the sheet P on the uppermost layer stacked on the sheet output tray 11. Each of the conductive members 16 is attached on the rear-side plate 2 of the image forming apparatus 1 so that it is arranged in the sheet width direction between the adjacent second sheet abutting members 14 in a state of being grounded at a position lower than the sheet drop height position. The plurality of conductive members 16 attracts the rear end portion Pd in the ejecting direction of the sheet P on the uppermost layer stacked on the sheet output tray 11, up to the sheet drop height position on the sheet regulating surface 14*a* of the second sheet abutting member 14.

The sheet ejection device 10 is provided with a controller 50 configured to control the sheet ejection device 10 as a whole.

Subsequently, each portion of the sheet ejection device 10 will be specifically described.

The sheet output tray 11 is formed into a rectangular shape on a plan view and has a front surface 11*a* located on the downstream side in the ejecting direction of the sheet P, a left side surface 11*b* and a right side surface 11*c* located on the left and right in the width direction of the sheet P, and a rear surface 11*d* located on the upstream side in the ejecting direction of the sheet P.

The sheet output tray 11 has a flat upper surface 11*e*, at the substantially central part between the side surfaces 11*b* and 11*c*, on which the sheet P is flatly stacked. The upper surface lie is formed in the sheet ejecting direction so as to connect to the front surface Ila and the rear surface 11*d*. The upper surface 11*e* crosses the rear-side plate 2 of the image forming apparatus 1 at right angles.

The sheet output tray 11 has inclined surfaces 11*f* and 11*g* connecting to the upper surface 11*e* on the left and right of the upper surface 11*e*. The inclined surfaces 11*f* and 11*g* are used for imparting stiffness to the sheet P on the right and left sides in the width direction into an appropriate shape to be stacked. The inclined surfaces 11*f* and 11*g* are inclined from the upper surface lie toward the side surfaces 11*b* and 11*c* so that the heights gradually increase.

On the upper surface lie and the inclined surfaces 11*f* and 11*g* of the sheet output tray 11, approximately 4000 sheets P of any one of various types of sheet sizes such as A3 size, A4 size and the like can be stacked.

In the present embodiment, the inclined surfaces 11*f* and 11*g* are formed on the left and right of the upper surface 11*e* of the sheet output tray 11 in order to impart stiffness to the left and right sides in the width direction of the sheet P. However, if there is no need to impart stiffness to the left and right sides in the width direction of the sheet P, the entire upper surface of the sheet output tray 11 may be formed as a flat sheet-stacking surface.

Subsequently, the sheet output tray elevation mechanism portion 20 for elevating up/down the sheet output tray 11 is provided on the right side surface 11*c* side of the sheet output tray 11. When approximately 4000 sheets P are to be stacked on the sheet output tray 11, the elevation amount of the sheet output tray 11 is set to approximately 400 mm to 500 mm.

In the sheet output tray elevation mechanism portion 20, brackets 21 and 22 are attached symmetrically on the front and rear at intervals perpendicularly on the front and rear of the right side surface 11*c* of the sheet output tray 11. Connecting rods 23 and 23 for reinforcement are laterally extended between the upper parts and the lower parts of the brackets 21 and 22.

A stepping motor 24 is mounted on the bracket 22. Rotation of the stepping motor 24 is transmitted to one gear 26 attached at one end of a shaft 25 laterally extended between the brackets 21 and 22 and the other gear 26 attached to the other end of the shaft 25, via a gear train (not shown).

The one gear 26 and the other gear 26 are meshed with racks 27 and 27 (only one rack 27 is shown in FIG. 1) installed vertically on the sides of the brackets 21 and 22, respectively.

By operating the stepping motor 24 and rotating the gears 26 and 26 along the racks 27 and 27 forward or backward, the sheet output tray 11 vertically moves up/down integrally with the brackets 21 and 22 while maintaining a horizontal state.

On the rear-side plate 2 of the image forming apparatus 1, the light-reflective type sensor 15 is attached at a position lower, by the sheet drop height H1, than the upper portion of the rear-side plate 2 serving as an ejection position.

If a light-transmissive type sensor (not shown) is used instead of the light-reflective type detection sensor 15, the rear-side plate 2 of the image forming apparatus 1 and a side plate (not shown) on the front of the front surface 11*a* of the sheet output tray 11 facing the rear-side plate 2 are provided, and a light emitting portion and a light receiving portion constituting the light transmissive type sensor may be attached to the rear-side plate 2 and the side plate, respectively.

The sensor 15 detects a height position of the upper surface 11*e* of the sheet output tray 11 on which no sheet P is stacked or a height position of the sheet P on the uppermost layer of the plurality of sheets P stacked on the upper surface 11*e* of the sheet output tray 11.

As a result, when the plurality of sheets P sequentially ejected from the image forming apparatus 1 drops onto the sheet output tray 11, the sheet drop height position is detected by the sensor 15 so that the sheet drop height H1 set between the ejection position where each sheet P is ejected, and the upper surface lie of the sheet output tray 11 on which no sheet P is stacked, or the sheet P on the uppermost layer of the plurality of sheets P stacked on the upper surface 11*e* of the sheet output tray 11, becomes substantially constant.

The controller 50 elevates up/down the sheet output tray 11 via the stepping motor 24 in accordance with the stacked amount of the sheets P on the basis of a detection result from the sensor 15 so that the sheet output tray 11 reaches the sheet drop height position. As described above, by maintaining the sheet drop height H1 when each ejected sheet P drops from the image forming apparatus 1 substantially constant, a large number of sheets P become able to be stacked on the sheet output tray 11.

Meanwhile, there is installed, at a lower part of the rack 27, a sheet full-stack detection sensor (not shown) for detecting that the sheets P are fully stacked on the sheet output tray 11 and the sheet output tray 11 has reached the lowermost position.

The first sheet abutting member 12 is formed into a rectangular shape by using a resin material or the like having rigidity and non-conductivity. The first sheet abutting member 12 is provided orthogonally to the ejecting direction of the sheet P in a state of being separated from the sheet output tray 11.

The first sheet abutting member 12 has a non-conductive sheet regulating surface 12*a* formed into a flat surface. When each sheet P ejected from the image forming apparatus 1 drops, the sheet regulating surface 12*a* abuts on the front end portion Pa of the sheet P and regulates movement of the front end portion Pa of the sheet P.

The first sheet abutting member moving mechanism portion 30 is formed as a unit and suspended from a top plate (not shown) between the rear-side plate 2 side of the image forming apparatus 1 and the front surface 11*a* side of the sheet output tray 11.

The first sheet abutting member 12 is perpendicularly mounted on a first support plate 31 of the first sheet abutting member moving mechanism portion 30. The first support plate 31 is formed by using a metal sheet material.

A first bracket 32 is mounted on the top plate (not shown) above the first support plate 31. A first motor 33 serving as a driving source of the first sheet abutting member moving mechanism portion 30 is mounted on the first bracket 32.

Two lengthy first guide shafts 34 and 34 are extended parallel to the upper surface 11*e* of the sheet output tray 11 in the sheet ejecting direction, between the first support plate 31 and the central part in the sheet width direction of the rear-side plate 2 of the image forming apparatus 1.

A first timing belt 37 is extended between a first timing pulley 35 mounted on a lower surface of the first bracket 32 and a second timing pulley 36 mounted on the central part in the sheet width direction of the rear-side plate 2 of the image forming apparatus 1.

By transmitting rotation of the first motor 33 to the first timing pulley 35, the first sheet abutting member 12 is made movable in the sheet ejecting direction integrally with the first support plate 31 in accordance with the length dimension of the sheet P.

The types of the plurality of sheets P stacked on the sheet output tray 11 include a thin sheet, a plain sheet or a thick sheet. Since the length dimension of each type of the sheet P is determined, the first sheet abutting member 12 stops at a length position of each sheet P to be stacked on the sheet output tray 11.

Each of the sheet width-direction regulating plates 13L and 13R is formed into a rectangular shape by using a resin material or the like having rigidity and non-conductivity. The sheet width-direction regulating plates 13L and 13R are provided symmetrically facing each other at intervals, parallel to the ejecting direction of the sheet P in a state of being separated from the sheet output tray 11.

The sheet width-direction regulating plates 13L and 13R have the non-conductive sheet regulating surfaces 13*a* and 13*a* each being formed as a flat surface. When each sheet P ejected from the image forming apparatus 1 drops, the sheet regulating surfaces 13*a* and 13*a* regulate movement of the left and right end portions Pb and Pc of the sheet P while guiding, in the ejecting direction, the left and right end portions Pb and Pc in the width direction of the sheet P. In order to reduce the weight, a plurality of holes 13*b* and 13*b* is formed in the regulating plates 13L and 13R, respectively.

The sheet width-direction regulating plate moving mechanism portion 40 is formed as a unit and suspended from the top plate (not shown) between the left side surface 11*b* side and the right side surface 11*c* side of the sheet output tray 11.

In the sheet width-direction regulating plate moving mechanism portion 40, the sheet width-direction regulating plates 13L and 13R are mounted perpendicularly on the second support plates 41L and 41R. The second support plates 41L and 41R are formed by using a sheet metal plate.

A second bracket 42 is mounted on the top plate (not shown) above the second support plate 41R. A second motor 43 serving as a driving source of the sheet width-direction regulating plate moving mechanism portion 40 is mounted on the second bracket 42.

Two lengthy second guide shafts 44 and 44 are extended parallel to the upper surface lie of the sheet output tray 11 in the sheet width direction between the second support plates 41L and 41R.

A second timing belt 47 is extended between a third timing pulley 45 mounted on the second support plate 41L and a fourth timing pulley 46 mounted on the second support plate 41R.

By transmitting rotation of the second motor 43 to the fourth timing pulley 46, the sheet width-direction regulating plates 13L and 13R are made movable in the sheet width direction integrally with the second support plates 41L and 41R in accordance with the width dimension of the sheet.

The sheet width-direction regulating plates 13L and 13R stop at a width position of the plurality of sheets P stacked on the sheet output tray 11.

Each of the second sheet abutting members 14 is formed into a rectangular shape by using a resin material or the like having rigidity and non-conductivity. Each of the second sheet abutting members 14 is provided orthogonally to the ejecting direction of the sheet P in a state of being separated from the sheet output tray 11.

The plurality of second sheet abutting members 14 is mounted in a perpendicular direction at predetermined intervals in the sheet width direction on the rear-side plate 2 of the image forming apparatus 1. In each of the second sheet abutting members 14, a lateral width dimension is B, a thickness in the depth direction corresponding to the sheet ejecting direction is T1, and a length dimension in the perpendicular direction corresponds to a height of the rear-side plate 2 (not shown) of the image forming apparatus 1.

Instead of mounting the second sheet abutting member on the whole surface of the rear-side plate 2 of the image forming apparatus 1, the plurality of second sheet abutting members 14 is mounted at predetermined intervals on the rear-side plate 2 of the image forming apparatus 1, and thus weight reduction and cost reduction of the second sheet abutting member 14 can be realized.

Each of the second sheet abutting members 14 has the non-conductive sheet regulating surface 14*a* formed as a flat surface. When each sheet P ejected from the image forming apparatus 1 drops, the sheet regulating surface 14*a* abuts on the rear end portion Pd of the sheet P and regulates movement of the rear end portion Pd of the sheet P.

A plurality of conductive members 16 is mounted on the rear-side plate 2 of the image forming apparatus 1 in a grounded state. The plurality of conductive members 16 has a function of, as will be described later, attracting the rear end portion Pd of the sheet P on the uppermost layer of the plurality of sheets P stacked on the sheet output tray 11, up to the sheet drop height position on the sheet regulating surfaces 14*a* of the plurality of second sheet abutting members 14.

In the present embodiment, a conductive brush using an ultra-thin stainless wire or a conductive carbon wire having flexibility and conductivity is used as the conductive member 16, but this is not limiting, and a metal material having favorable conductivity may be used.

Each of the conductive members (conductive brushes) 16 is mounted between the adjacent second sheet abutting members 14 in the sheet width direction of the rear-side plate 2 of the image forming apparatus 1. Each of the conductive members is mounted at a position lower than the position of the sheet drop height H1 (sheet drop height position) equal to the position of the sheet P on the uppermost layer of the plurality of sheets P stacked on the sheet output tray 11. Specifically, when the sheet drop height H1 is approximately 100 mm, each of the conductive members is mounted at a position (height H2) lower than the sheet drop height H1 by approximately 5 mm, for example.

When inclined surfaces 11*f* and 11*g* are formed on the sheet output tray 11, it is only necessary that each of the conductive members 16 is attached with inclination so as to follow the sheet width direction of the rear end portion Pd of the sheet P on the uppermost layer at the position lower than the height position of the sheet P on the uppermost layer.

In contrast, when the inclined surfaces 11*f* and 11*g* are not formed on the sheet output tray 11, the upper surface of the sheet output tray 11 is a flat sheet stacking surface, and thus it is only necessary to mount, horizontally to the sheet stacking surface, the conductive members 16 at the position lower than the height position of the sheet P on the uppermost layer.

In each of the conductive members 16, the thickness in the depth direction corresponding to the sheet ejecting direction is formed to T2. Since the thickness T2 in the depth direction of the conductive member 16 is set smaller than the thickness T1 in the depth direction of the second sheet abutting member 14 (T2<T1), each of the conductive members 16 withdraws from the sheet regulating surface 14*a* of the adjacent second sheet abutting member 14.

Therefore, each of the conductive members 16 is located behind the sheet regulating surface 14*a* of the adjacent second sheet abutting member 14.

Next, an action of the conductive member 16 will be described.

Meanwhile, in FIGS. 2 to 5, the sheet width-direction regulating plates 13L and 13R illustrated in FIG. 1 are omitted.

Furthermore, in FIGS. 2 to 5, the position of the sheet P on the uppermost layer of the plurality of sheets P stacked on the sheet output tray 11 is detected by the light-reflective type sensor 15 mounted at the position of the sheet drop height H1 on the rear-side plate 2 of the image forming apparatus 1, and the sheet output tray 11 is lowered in accordance with the stacked amount of the sheets P so that the position of the sheet P on the uppermost layer comes equal to the position of the sheet drop height H1 (sheet drop height position).

Figure 2:
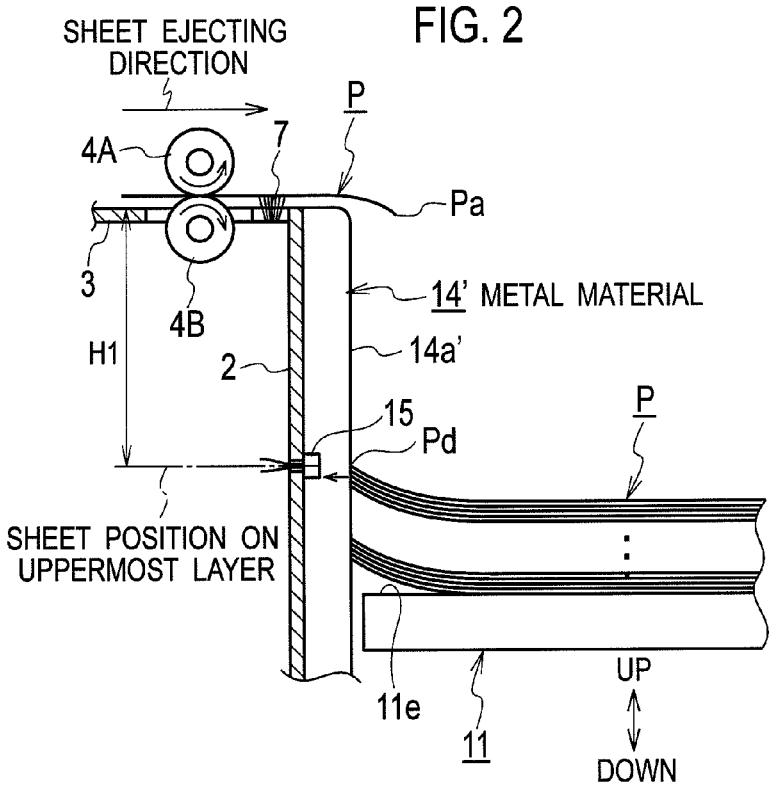
FIG. 2 is a diagram schematically illustrating a configuration in which an upper surface of a sheet output tray is set horizontally and a metal material is used as a second sheet abutting member, as a comparative example with respect to the sheet ejection device according to the embodiment of the present invention.

FIG. 2 is a diagram schematically illustrating, as a comparative example with respect to the sheet ejection device 10 of the present embodiment, a configuration in which the upper surface 11*e* of the sheet output tray 11 is installed horizontally and a metal material is used as each of the second sheet abutting members 14'.

In this comparative example, each of the second sheet abutting members 14' has a conductive sheet regulating surface 14*a'* formed as a flat surface. Each of the second sheet abutting members 14' abuts on the rear end portion Pd of the sheet P and regulates movement of the rear end portion Pd of the sheet P, when the sheets P are to be stacked on the basis of the upstream side in the sheet feeding direction on the sheet output tray 11 at the time of ejection of the sheets P.

The conductive member 16 is not mounted in the vicinity of the adjacent second sheet abutting member 14'.

The sheet P is ejected from the image forming apparatus 1 via the sheet feeding rollers 4A and 4B, static-eliminated by the static elimination brushes 7 and dropped onto the sheet output tray 11.

At this time, when the sheet P on the uppermost layer stacked on the sheet output tray 11, which has not been fully static-eliminated by the static elimination brushes 7 but in which static electricity remains on a part of the sheet, is a plain sheet or a thick sheet, even if the rear end portion Pb of the sheet P on the uppermost layer is attracted to the sheet regulating surface 14*a'* of each of the second sheet abutting members 14' by Coulomb force at the time of electrostatic induction, since the plain sheet or the thick sheet is heavy-weighted and has high rigidity, the sheets are little affected by the attracting force from each of the second sheet abutting members 14' and are stacked on the sheet output tray 11 in a flat state in contact with the sheet regulating surface 14*a'* of each of the second sheet abutting members 14'. Therefore, a plain sheet or a thick sheet can be aligned favorably on the sheet output tray 11.

In contrast, if a thin sheet is used as the sheet P, since the thin sheet is light-weighted and has small rigidity, the rear end portion Pd of the thin sheet is inclined while being attracted to the sheet regulating surface 14*a'* of each of the second sheet abutting members 14' by Coulomb force at the time of electrostatic induction as illustrated in FIG. 2, and the thin sheet is stacked on the sheet output tray 11, leaning on the sheet regulating surface 14*a'* of each of the second sheet abutting members 14'. Therefore, the thin sheet cannot be aligned favorably on the sheet output tray 11.

Moreover, when a thin sheet is used as the sheet P, the thin sheet to be subsequently ejected might collide against or overlap with the thin sheet leaning on the second sheet abutting member 14'. It is likely that an ejected sheet jam occurs in some cases.

Figure 3:
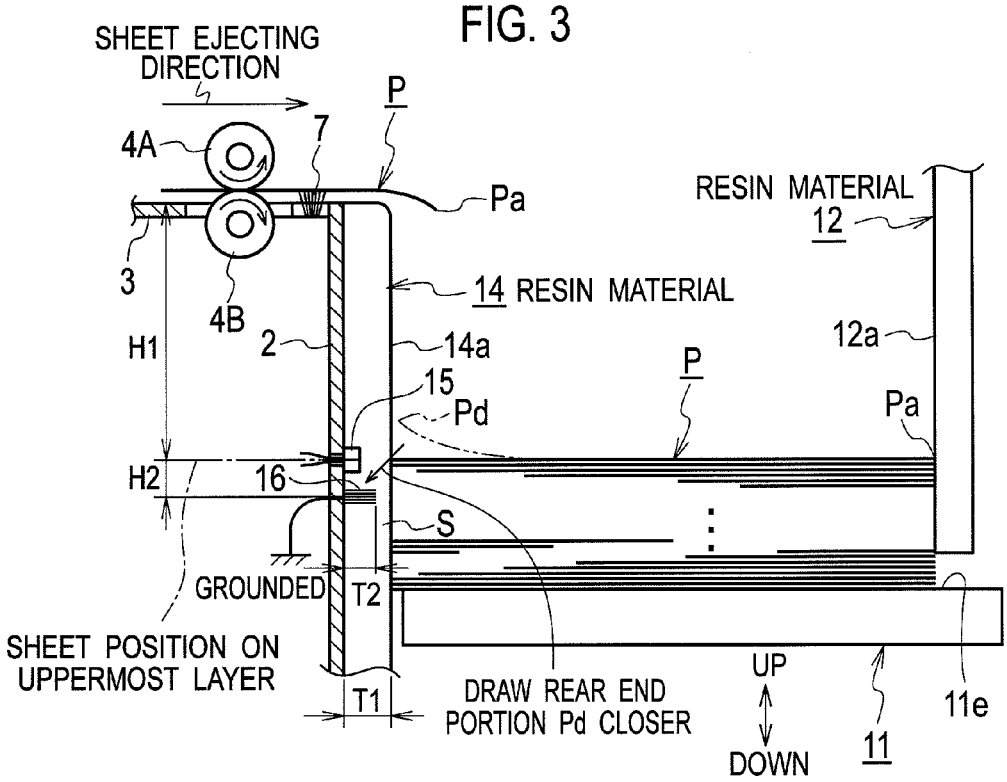
FIG. 3 is a diagram schematically illustrating a configuration in which the upper surface of the sheet output tray is set horizontally, a resin material or the like having non-conductivity is used as first and second sheet abutting members, and a conductive member is attached in the vicinity of the second sheet abutting member, as the sheet ejection device according to the embodiment of the present invention.

In order to solve the problem in the comparative example, in FIG. 3, there is schematically illustrated, as the sheet ejection device 10 of the present embodiment, a configuration in which the upper surface lie of the sheet output tray 11 is installed horizontally and a resin material or the like having non-conductivity is used as the first and second sheet abutting members 12 and 14, and a conductive member 16 is attached in the vicinity of each of the second sheet abutting members 14.

In the present embodiment, the first sheet abutting member 12 that abuts on the front end portion Pa of the sheet P and regulates movement of the front end portion Pa of the sheet P has the non-conductive sheet regulating surface 12*a* formed on a flat surface by using a resin material or the like. Moreover, each of the second sheet abutting members 14 that abuts on the rear end portion Pd of the sheet P and regulates movement of the rear end portion Pd of the sheet P has the non-conductive sheet regulating surface 14*a* formed on a flat surface by using a resin material or the like.

At a position lower than the sheet drop height H1 (=100 mm) by only the height H2 (=5 mm) on the rear-side plate 2 of the image forming apparatus 1, each of the conductive members (conductive brushes) 16 is attached in the width direction of the sheet P.

Since the thickness T2 in the depth direction of the conductive member (conductive brush) 16 corresponding to the sheet ejecting direction is set smaller than the thickness T1 in the depth direction of the second sheet abutting member 14, a slight gap S is formed between the conductive member 16 and the sheet regulating surface 14*a* of the second sheet abutting member 14.

Here, when any of all the types of sheets P such as a thin sheet, a plain sheet, a thick sheet and the like is ejected from the image forming apparatus 1 through the sheet feeding rollers 4A and 4B, static-eliminated by the static elimination brushes 7, and dropped onto the sheet output tray 11 from the front end portion Pa of the sheet P as the head, if the sheet P not fully static-eliminated by the static elimination brushes 7 and still partially electrostatically charged is stacked on the sheet output tray 11, the front end portion Pa of the sheet P on the uppermost layer abuts on the sheet regulating surface 12*a* of the first sheet abutting member 12. At this time, since the sheet regulating surface 12*a* of the first sheet abutting member 12 is formed as a non-conductive flat surface, the front end portion Pa of the sheet P on the uppermost layer is brought into contact with the sheet regulating surface 12*a*, in a substantially perpendicular posture without inclination. Therefore, particularly even if the sheet P is a thin sheet, the front end portion Pa side of the sheet P can be stacked, in an orderly manner, on the sheet output tray 11.

In contrast, the rear end portion Pd of the sheet P to be on the uppermost layer stacked on the sheet output tray 11 remaining still partially electrostatically charged, is dropped along the sheet regulating surface 14*a* of each of the second sheet abutting members 14 having non-conductivity while being influenced by an electrostatic force from the metal rear-side plate 2 to which the plurality of second sheet abutting members 14 is attached.

At this time, even if the rear end portion Pd of the sheet P on the uppermost layer of the plurality of sheets P stacked on the sheet output tray 11 remaining partially electrostatically charged is brought into contact, with inclination, with the sheet regulating surface 14*a* of each of the second sheet abutting members 14 having non-conductivity, as indicated by a two-dot chain line, caused by the electrostatic force from the metal rear-side plate 2, the rear end portion Pd of the sheet P on the uppermost layer is attracted diagonally downward to the left up to the sheet drop height position on the sheet regulating surface 14*a* of each of the second sheet abutting members 14, by Coulomb force at the time of electrostatic induction from the conductive members (conductive brushes) 16 attached in the vicinity of each of the second sheet abutting members 14.

Since each of the conductive members 16 has the thickness T2, in the depth direction corresponding to the sheet ejecting direction, set smaller than the thickness T1 in the depth direction of the second sheet abutting member 14, it is located behind the sheet regulating surface 14*a* of each of the second sheet abutting members 14. Thus, the rear end portion Pd of the sheet P on the uppermost layer can be reliably brought into contact, without inclination, with the sheet regulating surface 14*a* of each of the second sheet abutting members 14.

As a result, since the rear end portion Pd of the sheet P to be on the uppermost layer stacked on the sheet output tray 11 is brought into contact, without inclination, with the sheet regulating surface 14*a* of each of the second sheet abutting members 14 in a substantially perpendicular posture without inclination, the rear end portion Pd side of the sheet P can be stacked, in an orderly manner, on the sheet output tray 11. Particularly, when a thin sheet in which the sheet P is light-weighted and has small rigidity is used, the effect of orderly arrangement of thin sheet on the sheet output tray 11 becomes more remarkable.

Furthermore, the thin sheet can be stacked, in an orderly manner, on the sheet output tray 11 without the rear end portion Pd side thereof leaning on the sheet regulating surface 14*a* of each of the second sheet abutting members 14. Thus, when a thin sheet is used, an ejected sheet jam which is likely to occur in some cases can be prevented.

Moreover, the sheet P on which static electricity partially remains can be static-eliminated by the plurality of conductive members (conductive brushes) 16.

The sheet width-direction regulating plates (side fences) 13L and 13R have non-conductive sheet regulating surfaces 13*a* and 13*a* formed as a flat surface, respectively. The sheet regulating surfaces 13*a* and 13*a* regulate movement of the left and right end portions Pb and Pc of the sheet P while guiding the left and right end portions Pb and Pc of the sheet P in the ejecting direction. Thus, particularly, even if the sheet P is a thin sheet, there is no trouble and the left and right end portions Pb ad Pc of the sheet P are brought into contact, without inclination, with the sheet regulating surfaces 13*a* and 13*a* of the sheet width-direction regulating plates 13L and 13R. As a result, the left and right end portions Pb and Pc sides of the sheet P can be stacked, in an orderly manner, on the sheet output tray 11.

Figure 4:
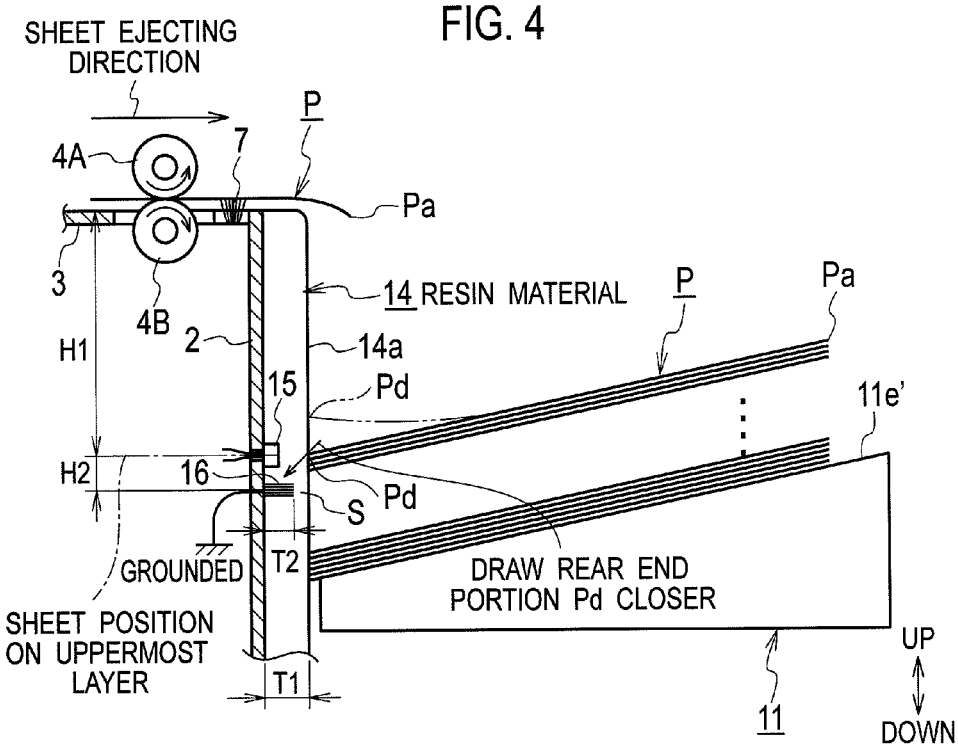
FIG. 4 is a diagram schematically illustrating a configuration in which the upper surface of the sheet output tray is set with inclination downward to the left, a resin material or the like having non-conductivity is used as the second sheet abutting member, and the conductive member is attached in the vicinity of the second sheet abutting member, as a sheet ejection device according to a first modification of the embodiment of the present invention.

FIG. 4 schematically illustrates, as a first modification in which a part of the sheet ejection device 10 of the present embodiment is deformed, a configuration in which an upper surface 11*e*' of the sheet output tray 11 is installed with inclination downward to the left, a resin material or the like having non-conductivity is used for each of the second sheet abutting members 14, and the conductive member 16 is attached in the vicinity of each of the second sheet abutting members 14.

In the case of the first modification, since the upper surface 11*e*' of the sheet output tray 11 is inclined downward to the left, the sheet P to be stacked on the upper surface 11*e*' of the sheet output tray 11 slides downward to the left by the gravity, and thus the first sheet abutting member that abuts on the front end portion Pa of the sheet P and regulates movement of the front end portion Pa of the sheet P is deleted.

Also in the first modification, the sheet P can be stacked, in an orderly manner, on the sheet output tray 11 by the action of the conductive members (conductive brushes) 16.

Figure 5:
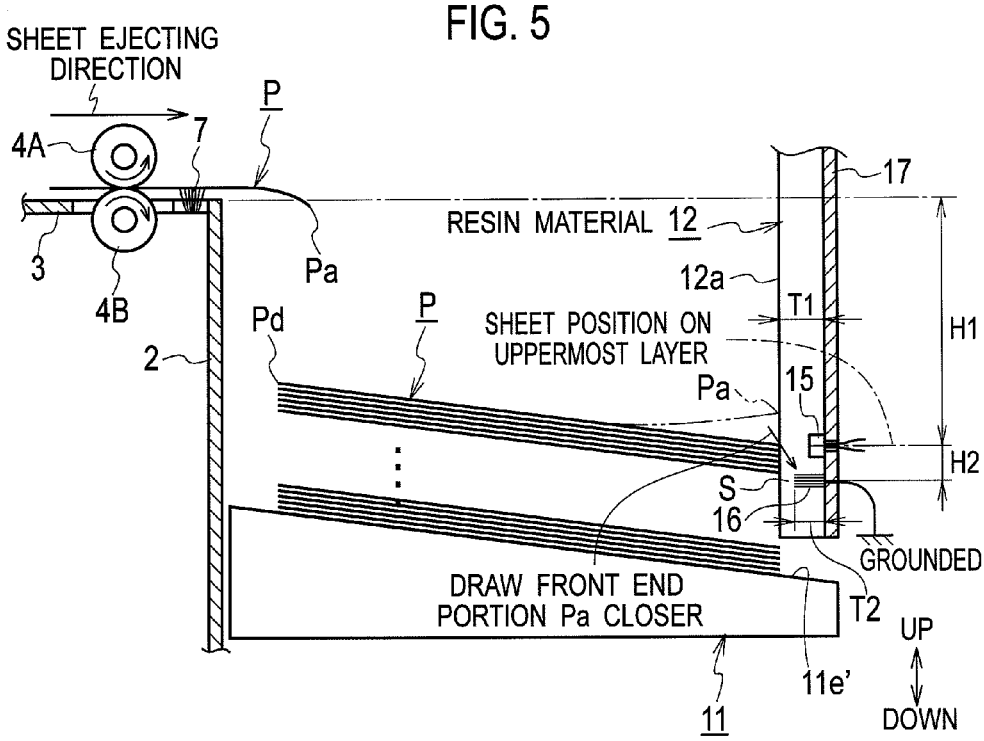
FIG. 5 is a diagram schematically illustrating a configuration in which the upper surface of the sheet output tray is set with inclination downward to the right, a resin material or the like having non-conductivity is used as the first sheet abutting member, and the conductive member is attached in the vicinity of the first sheet abutting member, as a sheet ejection device according to a second modification of the embodiment of the present invention.

FIG. 5 schematically illustrates, as a second modification in which a part of the sheet ejection device 10 of the present embodiment is deformed, a configuration in which an upper surface 11*e*" of the sheet output tray 11 is installed with inclination downward to the right, a resin material or the like having non-conductivity is used for the first sheet abutting member 12, and the conductive member 16 is attached in the vicinity of the first sheet abutting member 12.

In the case of the second modification, since the upper surface 11*e*" of the sheet output tray 11 is inclined downward to the right, the sheet P to be stacked on the upper surface 11*e*" of the sheet output tray 11 slides downward to the right by the gravity, and thus the second sheet abutting member that abuts on the rear end portion Pd of the sheet P and regulates movement of the rear end portion Pd of the sheet P is deleted.

In contrast, the first sheet abutting member 12 formed by using a resin material or the like for abutting on the front end portion Pa of the sheet P and regulating movement of the front end portion Pa of the sheet P is attached to a metal plate 17 by extending the sheet width direction. The first sheet abutting member 12 is configured such that the first sheet abutting member 12 is movable integrally with the metal plate 17 in the sheet ejecting direction.

The metal plate 17 is provided with the light-reflective type sensor 15 which detects the position of the sheet drop height H1 (sheet drop height position) and a conductive member 16 attached in the sheet width direction at a position lower than the sheet drop height position and in the grounded state in the vicinity of the first sheet abutting member 12. The conductive member 16 is grounded by using a conductive brush or the like in order to attract the front end portion Pa of the uppermost layer sheet P of the plurality of sheets P stacked on the sheet output tray 11, up to the sheet drop height position by the sheet regulating surface 12*a* of the first sheet abutting member 12.

Therefore, in the second modification, even if the front end portion Pa of the sheet P on the uppermost layer on the plurality of sheets P stacked on the sheet output tray 11 remaining partially electrostatically charged is brought into contact, with inclination, with the sheet regulating surface 12*a* of the first sheet abutting member 12 having non-conductivity, as indicated by a two-dot chain line, caused by the electrostatic force from the metal plate 17, the front end portion Pa of the sheet P on the uppermost layer is attracted diagonally downward to the right, up to the sheet drop height position on the sheet regulating surface 12*a* of the first sheet abutting member 12, by Coulomb force at the time of electrostatic induction from the conductive member (conductive brush) 16 attached in the vicinity of the first sheet abutting member 12.

As a result, since the front end portion Pa of the sheet P is brought into contact with the sheet regulating surface 12*a* of the first sheet abutting member 12 without inclination, the front end portion Pa side of the sheet P can be stacked, in an orderly manner, on the sheet output tray 11. Particularly, when a thin sheet in which the sheet P is light-weighted and has small rigidity is used, the effect of orderly arrangement of thin sheet on the sheet output tray 11 becomes more remarkable.

According to the present embodiment and the first and second modifications, the sheet ejection device 10 is provided with a plurality of the sheet abutting members 14 (or 12) and a plurality of the conductive members 16. Each of the sheet abutting members 14 (or 12) has the non-conductive sheet regulating surface 14*a* (or 12*a*) that abuts on the end portion Pd (or Pa) in the ejecting direction of the sheet P on the sheet output tray 11 and that regulates movement of the end portion Pd (or Pa), when the plurality of sheets P ejected in the sheet ejecting direction are sequentially dropped from the ejection position and the plurality of sheets P are stacked on the sheet output tray 11. Each of the conductive members 16 is attached at a position lower than the sheet drop height position and in the vicinity of the sheet abutting member 14 (or 12) in a state grounded in the sheet width direction. Each of the conductive members 16 attracts the end portion Pd (or Pa) in the ejecting direction of the sheet P on the uppermost layer of the plurality of sheets P stacked on the sheet output tray 11, up to the sheet drop height position on the sheet regulating surface 14*a* (or 12*a*) of the plurality of sheet abutting members 14 (or 12).

As a result, for all the types of the sheets P such as a thin sheet, a plain sheet, a thick sheet and the like, the end portion Pd (or Pa) in the ejecting direction of the sheet P on the uppermost layer of the plurality of sheets P stacked on the sheet output tray 11 is attracted up to the sheet drop height position on the sheet regulating surface 14*a* (or 12*a*) of the plurality of sheet abutting members 14 (or 12), by Coulomb force during electrostatic induction from the conductive member (conductive brush) 16 attached in the vicinity of each of the sheet abutting members 14 (or 12). Therefore, since the end portion Pd (or Pa) in the ejecting direction of the sheet P on the uppermost layer is brought into contact, without inclination, with the sheet regulating surface 14*a* (or 12*a*) of the sheet abutting member 14 (or 12), the end portion Pd (or Pa) side in the ejecting direction of the sheet P can be stacked, in an orderly manner, on the sheet output tray 11. Particularly when thin sheet in which the sheet P is light-weighted and has small rigidity is used, the effect of orderly arrangement of the thin sheet on the sheet output tray 11 becomes further remarkable.

Since a thin sheet can be stacked, in an orderly manner, on the sheet output tray 11, an ejected sheet jam which is likely to occur when thin sheet is used can be prevented.

What is claimed is:

1. A sheet ejection device in which a plurality of sheets ejected in a sheet ejecting direction is sequentially dropped from an ejection position and the plurality of sheets are stacked on a sheet output tray, the device comprising:

a detector that detects a sheet drop height position set between the ejection position and a sheet on an uppermost layer of the plurality of sheets stacked on the sheet output tray;

a sheet output tray elevation portion that elevates up/down the sheet output tray in accordance with a stacked amount of the plurality of sheets so that the sheet drop height position becomes substantially constant on the basis of a detection result from the detector;

a sheet abutting member that has a non-conductive sheet regulating surface that abuts on at least one of the front end portion and a rear end portion of each sheet on the sheet output tray to regulate movement of the one end portion; and a conductive member that is attached only at a position lower than the sheet drop height position and in the vicinity of the sheet abutting member in the grounded state in the sheet width direction, and attracts at least one of a front end portion and a rear end portion of the sheet on the uppermost layer of the plurality of sheets stacked on the sheet output tray, up to the sheet drop height position on the sheet regulating surface of the sheet abutting member.

2. The sheet ejection device according to claim 1, wherein the conductive member is located behind the sheet regulating surface of the sheet abutting member.

3. A sheet ejection device in which a plurality of sheets ejected in a sheet ejection direction is sequentially dropped from an ejection position and the plurality of sheets are stacked on a sheet output tray, the device comprising:

a detector that detects a sheet drop height position between the ejection position and a sheet on an upper most layer of the plurality of sheets stacked on the sheet output tray;

a sheet output tray elevation portion that elevates up/down the sheet output tray in accordance with a stacked amount of the plurality of sheets so that the sheet drop height position becomes substantially constant on the basis of a detection result from the detector;

a sheet abutting member that has a non-conductive sheet regulating surface that abuts on at least one of a front end portion and a rear end position of each sheet on the sheet output tray to regulate movement of the one end portion; and at least one conductive member that is attached at a position lower than the sheet drop height position in the vicinity of the sheet abutting member in a grounded state in the sheet width direction, and attracts at least one of a front end portion and a rear end portion of the sheet on the uppermost layer of the plurality of sheets stacked on the sheet output tray up to the sheet drop height position on the sheet regulating surface of the sheet abutting member, wherein each of the at least one conductive members is located fully behind the sheet regulating surface of the sheet abutting member.

* * * * *